US011779100B2

(12) United States Patent
Bruhns

(10) Patent No.: US 11,779,100 B2
(45) Date of Patent: Oct. 10, 2023

(54) FOLDING KNIFE WITH POCKET CLIP

(71) Applicant: Hogue Tool & Machine, Inc., Paso Robles, CA (US)

(72) Inventor: James David Bruhns, Templeton, CA (US)

(73) Assignee: HOGUE TOOL & MACHINE, INC., Paso Robles, CA (US)

( * ) Notice: Subject to any disclaimer, the term of this patent is extended or adjusted under 35 U.S.C. 154(b) by 224 days.

(21) Appl. No.: 17/477,146

(22) Filed: Sep. 16, 2021

(65) Prior Publication Data

US 2022/0079327 A1 Mar. 17, 2022

Related U.S. Application Data

(60) Provisional application No. 63/079,517, filed on Sep. 17, 2020.

(51) Int. Cl.
*A45F 5/02* (2006.01)
*B26B 1/02* (2006.01)

(52) U.S. Cl.
CPC ..... *A45F 5/022* (2013.01); *B26B 1/02* (2013.01); *A45F 2200/0575* (2013.01)

(58) Field of Classification Search
CPC ..... B62B 1/00; B62B 1/02; B62B 1/10; A45F 5/00; A45F 5/021; A45F 5/022; A45F 2200/0575
USPC ..... 224/669; 24/3.11, 11 F; D19/196; D8/99
See application file for complete search history.

(56) References Cited

U.S. PATENT DOCUMENTS 1,478,049 A * 12/1923 Nelson ..... B43K 25/024 D19/197
D103,812 S * 3/1937 Esterow ..... D19/196
D191,077 S * 8/1961 Lovejoy ..... D19/196
3,950,823 A * 4/1976 Schreter ..... A44B 6/00 24/562
D348,775 S * 7/1994 Scheid ..... D3/218
D379,558 S * 6/1997 Mischenko ..... D3/215
D402,177 S * 12/1998 Glesser ..... D8/99
D438,249 S * 2/2001 Hollington ..... D19/918
D446,547 S * 8/2001 Nagel ..... D19/197
D487,628 S * 3/2004 Mathews ..... D3/215
D490,109 S * 5/2004 Finney ..... D19/906
D507,303 S * 7/2005 Andrews ..... D19/918
D517,892 S * 3/2006 Galyean ..... D8/99
D581,311 S * 11/2008 Cornett ..... D11/78.1
D636,293 S * 4/2011 Dolce ..... D11/222
(Continued)

*Primary Examiner* — Justin M Larson
(74) *Attorney, Agent, or Firm* — Bennet K. Langlotz; Langlotz Patent & Trademark Works, LLC

(57) ABSTRACT

A folding knife with pocket clip has a knife frame, a flexible elongated resilient pocket clip having a first end connected to the knife frame and a second free end proximate the knife frame, the flexible elongated resilient pocket clip defining a plurality of louvers, each louver defining a slit transverse to the length of the flexible elongated resilient pocket clip and having an elevated edge, and each elevated edge facing toward the second free end. The louvers may be parallel to each other. The louvers may be at an intermediate location spaced apart from the first end and second free end. The knife frame may have a pivot end to which a blade is pivotally attached, and the elevated edges may face toward the pivot end.

20 Claims, 3 Drawing Sheets

(56) References Cited

U.S. PATENT DOCUMENTS

| | | | | |
|---|---|---|---|---|
| 8,028,873 | B2 * | 10/2011 | Hawk | A45F 5/022 24/3.12 |
| D670,903 | S * | 11/2012 | Ormsbee | D3/215 |
| 8,783,141 | B2 * | 7/2014 | Caswell | B26B 11/00 83/13 |
| 9,289,903 | B1 * | 3/2016 | Douzanis | B26B 1/10 |
| D771,371 | S * | 11/2016 | Taylor | D3/215 |
| D831,114 | S * | 10/2018 | Csokmay | D19/196 |
| D857,474 | S * | 8/2019 | Lazenby | D8/99 |
| D862,067 | S * | 10/2019 | Feng | D3/207 |
| 10,478,976 | B2 * | 11/2019 | Liang | B26B 1/02 |
| 11,141,870 | B1 * | 10/2021 | Goldstein | B26B 1/10 |
| 11,192,267 | B1 * | 12/2021 | Omelchenko | B26B 1/048 |
| D939,825 | S * | 1/2022 | Omelchenko | D19/197 |
| D981,705 | S * | 3/2023 | Laemle | D3/207 |
| 2019/0366567 | A1 * | 12/2019 | Mitchell | B26B 1/10 |
| 2020/0254635 | A1 * | 8/2020 | Bruhns | B26B 1/044 |
| 2022/0079327 | A1 * | 3/2022 | Bruhns | B26B 1/02 |

* cited by examiner

FOLDING KNIFE WITH POCKET CLIP

CROSS-REFERENCE TO RELATED APPLICATION

This application claims the benefit of U.S. Provisional Patent Application No. 63/079,517 filed on Sep. 17, 2020, entitled "Louvered Clip," which is hereby incorporated by reference in its entirety for all that is taught and disclosed therein.

FIELD OF THE INVENTION

The present invention relates to knives, and more particularly to a folding knife with pocket clip that enables the folding knife to be easily withdrawn with one hand from a pocket or pouch.

BACKGROUND AND SUMMARY OF THE INVENTION

It is common to carry a pocketknife or pocket tool in a pocket of clothing or a carry bag. However, it can be easy to lose one's grip on a knife when removing it from a pouch or a pocket, which can be dangerous. It is particularly desirable to be able to retrieve a pocketknife or pocket tool with only one hand from a typical pocket of clothing or carry bag or anywhere such a device might be stowed or carried. However, attempting to do so one-handed makes the potential to lose one's grip on the knife even easier.

Therefore, a need exists for a new and improved folding knife with pocket clip that enables the folding knife to be easily withdrawn with one hand from a pocket or pouch. In this regard, the various embodiments of the present invention substantially fulfill at least some of these needs. In this respect, the folding knife with pocket clip according to the present invention substantially departs from the conventional concepts and designs of the prior art, and in doing so provides an apparatus primarily developed for the purpose of enabling the folding knife to be easily withdrawn with one hand from a pocket or pouch.

The present invention provides an improved folding knife with pocket clip, and overcomes the above-mentioned disadvantages and drawbacks of the prior art. As such, the general purpose of the present invention, which will be described subsequently in greater detail, is to provide an improved folding knife with pocket clip that has all the advantages of the prior art mentioned above.

To attain this, the preferred embodiment of the present invention essentially comprises a knife frame, a flexible elongated resilient pocket clip having a first end connected to the knife frame and a second free end proximate the knife frame, the flexible elongated resilient pocket clip defining a plurality of louvers, each louver defining a slit transverse to the length of the flexible elongated resilient pocket clip and having an elevated edge, and each elevated edge facing toward the second free end. The louvers may be parallel to each other. The louvers may be at an intermediate location spaced apart from the first end and second free end. The knife frame may have a pivot end to which a blade is pivotally attached, and the elevated edges may face toward the pivot end. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
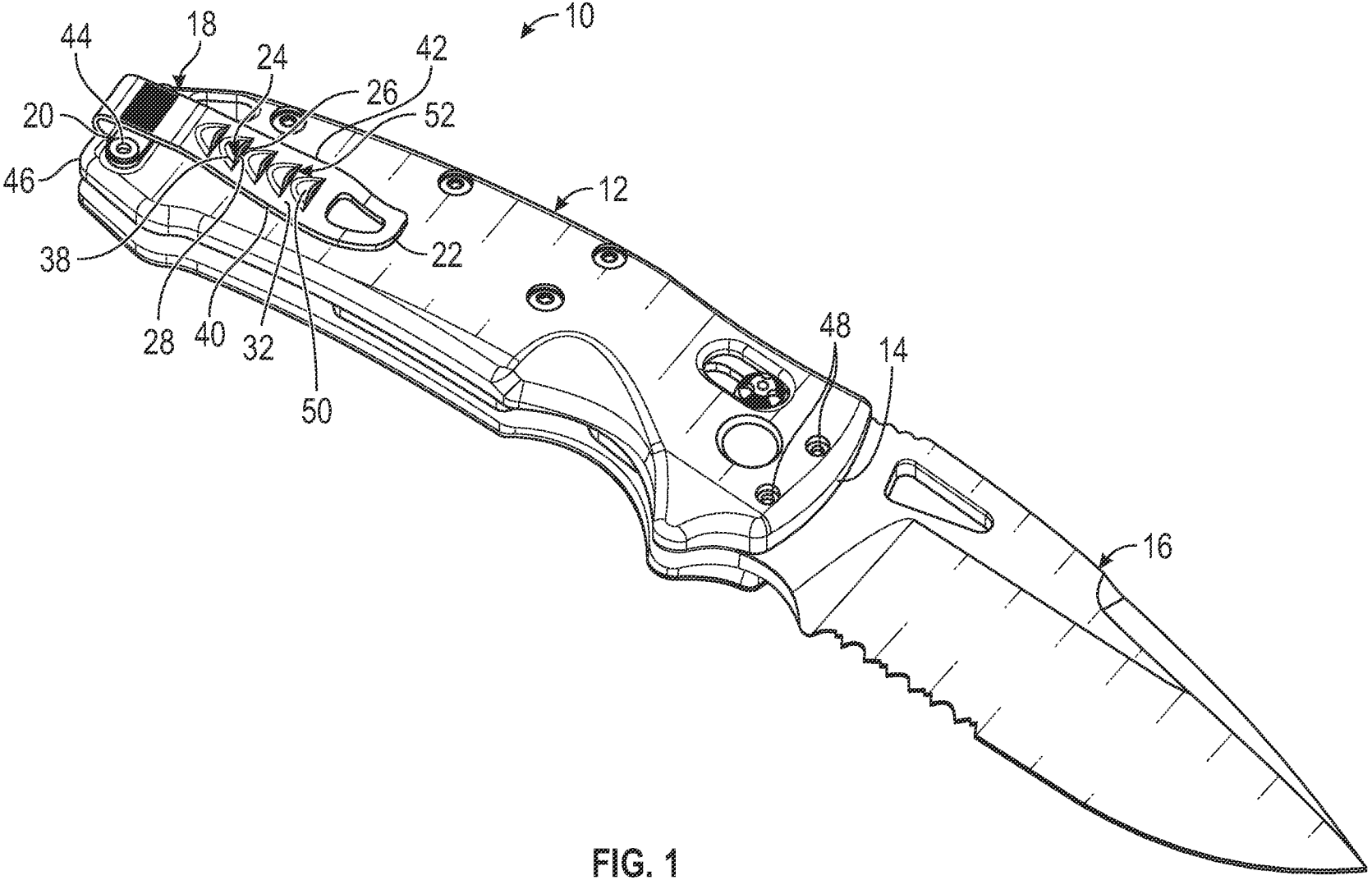
FIG. 1 is an isometric view of the current embodiment of a folding knife with pocket clip constructed in accordance with the principles of the present invention with the blade in the unfolded condition.
Figure 2:
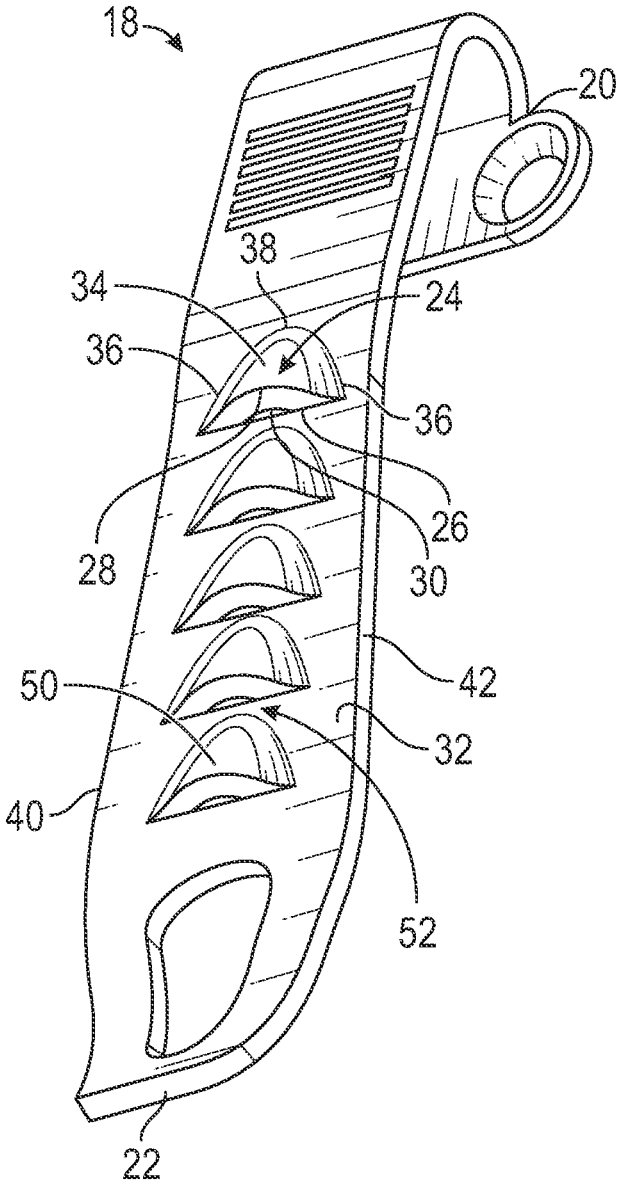
FIG. 2 is an isometric view of the pocket clip of FIG. 1.
Figure 3:
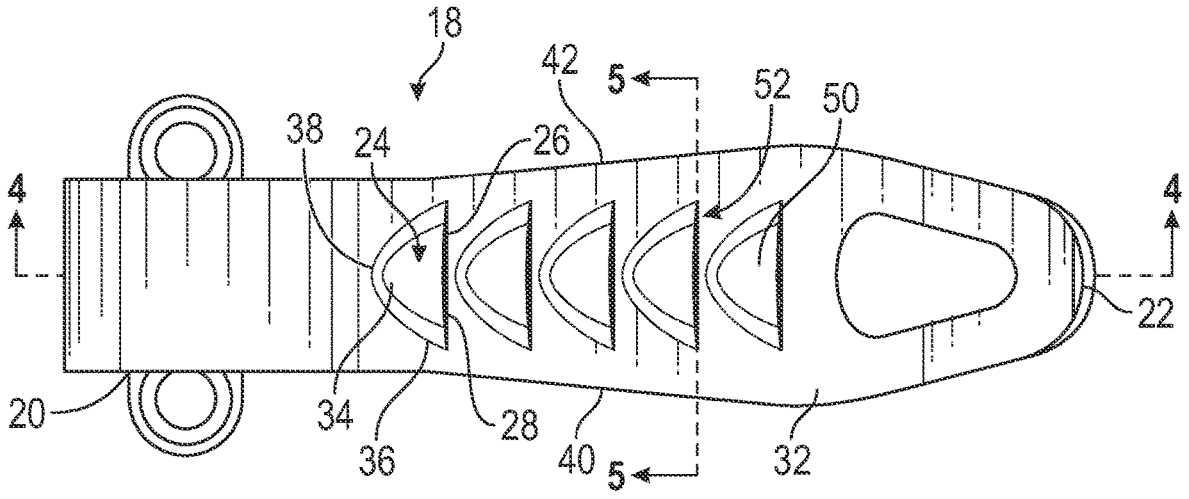
FIG. 3 is a top view of the pocket clip of FIG. 1.
Figure 4:
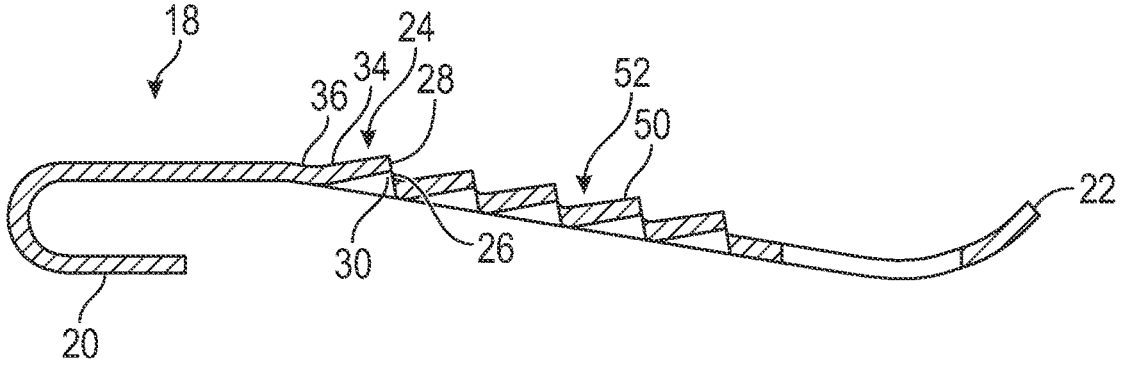
FIG. 4 is a sectional view taken along line 4-4 of FIG. 3.
Figure 5:
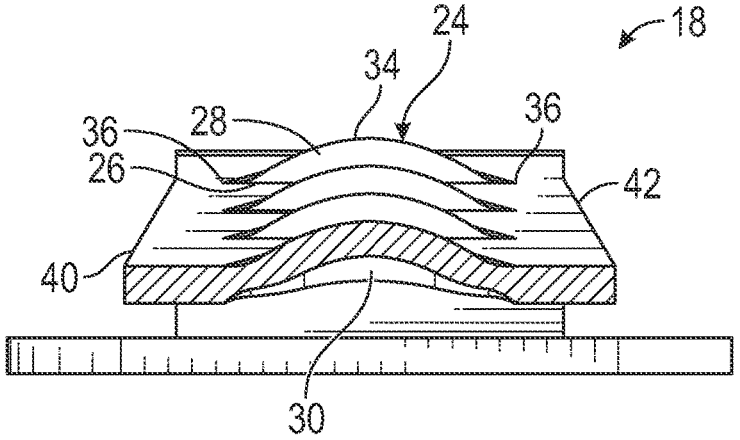
FIG. 5 is a sectional view taken along line 5-5 of FIG. 3.

An embodiment of the folding knife with pocket clip of the present invention is shown and generally designated by the reference numeral 10.

FIG. 1 illustrates the improved folding knife with pocket clip 10 of the present invention, and FIGS. 2-5 illustrate the pocket clip removed from the folding knife. More particularly, the folding knife with pocket clip has a knife frame 12. The knife frame has a pivot end 14 to which a blade 16 is pivotally attached. In FIG. 1, the blade is shown in the unfolded position. A flexible elongated resilient pocket clip 18 having a first end 20 is connected to the knife frame. The flexible elongated resilient pocket clip also has a second free end 22 proximate the knife frame. The flexible elongated resilient pocket clip defines a plurality of louvers/deflected portions 24. Each louver defines a slit 26 transverse to the length of the flexible elongated resilient pocket clip and has an elevated edge 28 at the slit.

In the current embodiment, each elevated edge 28 faces toward the second free end 22 of the flexible elongated resilient pocket clip 18. The louvers 24 are parallel to each other. The louvers are at an intermediate location spaced apart from the first end 20 and second free end. The elevated edges face toward the pivot end 14 of the knife frame 12. The flexible elongated resilient pocket clip has a selected thickness, and each louver is deflected by an amount greater than the thickness. Each louver defines an aperture 30 extending through the flexible elongated resilient pocket clip. The flexible elongated resilient pocket clip has a planar major surface 32, and each louver has an area 34 deflected from the planar major surface, the louver being continuous with the planar major surface on all sides except the slit 26. In the context of the specification, "continuous" means without a discontinuity at any bend point 36. The sheet metal of the flexible elongated resilient pocket clip is bent at these edges, but remains unsheared. Each louver has an arc-shaped periphery 38 connected to the flexible elongated resilient pocket clip. Each slit is a straight line. The flexible elongated resilient pocket clip is a planar body having opposed elongated side edges 40, 42. The louvers are spaced apart from the opposed elongated side edges.

The flexible elongated resilient pocket clip 18 is releasably attached to the knife frame 12 by screws 44 (only one of which is visible) received in a pair of threaded apertures (not visible) at a free end 46 of the knife frame. The knife frame also has a pair of threaded apertures 48 at the pivot end 14 so the user can change the attachment position of the flexible elongated resilient pocket clip to the pivot end of the knife frame if desired.

The flexible elongated resilient pocket clip 18 clips over the outside of a pocket or pouch when the folding knife with pocket clip 10 is in the folded position and stowed condition. The plurality of louvers 24 provide enhanced grip for a more reliable grasp by the user when retrieving the folding knife with pocket clip from a pocket or pouch. The elevated edges 28 face toward the second free end 22 of the flexible elongated resilient pocket clip so the elevated edges are in a direction opposite the force of extraction of the folding knife with pocket clip from a pocket or pouch. The elevated edges provide a grip advantage only in one direction. The slope 50 of the unsheared side of each louver provides space 52 for the user's gripping finger to enter the space to engage the adjacent louver's elevated edge more readily. However, the plurality of louvers could be sheared on both sides, thereby providing straps that are connected to the flexible elongated resilient pocket clip only at their ends, which would create an enhanced gripping effect in both directions, and also provide different manufacturability and use advantages.

The plurality of louvers 24 are particularly advantageous in that the stamping and forming process that creates the flexible elongated resilient pocket clip 18 can form the flexible elongated resilient pocket clip's contour, hold, and periphery in a single sequence of steps, or even in a single operation. This contrasts with conventional friction features that are typically applied in a separate manufacturing step.

While a current embodiment of a folding knife with pocket clip has been described in detail, it should be apparent that modifications and variations thereto are possible, all of which fall within the true spirit and scope of the invention. Although folding knives have been disclosed, the flexible elongated resilient pocket clip is also suitable for use with any other type of pocket tool or object carried in a pocket or bag where clipping the pocket tool or object to the exterior of the pocket or bag is desirable. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A knife comprising:

a knife frame;

a flexible elongated resilient pocket clip having a first end connected to the knife frame and a second free end proximate the knife frame;

the flexible elongated resilient pocket clip defining a plurality of louvers;

each louver defining a slit transverse to the length of the flexible elongated resilient pocket clip and having an elevated edge; and each elevated edge facing toward the second free end.

2. The knife of claim 1 wherein the louvers are parallel to each other.

3. The knife of claim 1 wherein the louvers are at an intermediate location spaced apart from the first end and second free end.

4. The knife of claim 1 wherein the knife frame has a pivot end to which a blade is pivotally attached, and wherein the elevated edges face toward the pivot end.

5. The knife of claim 1 wherein the flexible elongated resilient pocket clip has a selected thickness, and each louver is deflected by an amount greater than the thickness.

6. The knife of claim 1 wherein each louver defines an aperture extending through the flexible elongated resilient pocket clip.

7. The knife of claim 1 wherein the flexible elongated resilient pocket clip has a planar major surface and each louver has an area deflected from the planar major surface, the louver being continuous with the planar major surface on all sides except the slit.

8. The knife of claim 1 wherein each louver has an arc-shaped periphery connected to the flexible elongated resilient pocket clip.

9. The knife of claim 1 wherein each slit is a straight line.

10. The knife of claim 1 wherein the flexible elongated resilient pocket clip is a planar body having opposed elongated side edges, and wherein the louvers are spaced apart from the opposed elongated side edges.

11. A knife comprising:

a frame;

a planar elongated pocket clip having a first end connected to the frame and a second free end proximate the frame;

the planar elongated pocket clip having a major surface facing away from the frame;

the planar elongated pocket clip defining a plurality of slits transverse to the length of the planar elongated pocket clip;

a deflected portion of the planar elongated pocket clip adjacent to each slit and having an elevated edge at the slit.

12. The knife of claim 11 wherein each elevated edge faces toward the second free end.

13. The knife of claim 11 wherein the slits are at an intermediate location spaced apart from the first end and second free end.

14. The knife of claim 11 wherein the frame has a pivot end to which a blade is pivotally attached, and wherein the elevated edges face toward the pivot end.

15. The knife of claim 11 wherein the planar elongated pocket clip has a selected thickness, and each deflected portion is deflected by an amount greater than the thickness.

16. The knife of claim 11 wherein each slit defines an aperture extending through the clip.

17. The knife of claim 11 wherein the planar elongated pocket clip has a planar major surface and each deflected portion being continuous with the major planar surface on all sides except the slit.

18. The knife of claim 11 wherein each deflected portion has an arc-shaped periphery connected to the planar elongated pocket clip.

19. The knife of claim 11 wherein each slit is a straight line.

20. The knife of claim 11 wherein the planar elongated pocket clip is a planer body having opposed elongated side edges, and wherein the slits are spaced apart from the opposed elongated side edges.

* * * * *